US009057211B2

(12) United States Patent
Scholz

(10) Patent No.: US 9,057,211 B2
(45) Date of Patent: Jun. 16, 2015

(54) LOCK UNIT HAVING A MULTI-PART PAWL AND A SPRING-LOADED BLOCKING PAWL

(75) Inventor: Michael Scholz, Essen (DE)

(73) Assignee: Kiekert AG, Heiligenhaus (DE)

( * ) Notice: Subject to any disclaimer, the term of this patent is extended or adjusted under 35 U.S.C. 154(b) by 338 days.

(21) Appl. No.: 13/119,957

(22) PCT Filed: Sep. 18, 2009

(86) PCT No.: PCT/DE2009/001318

§ 371 (c)(1),
(2), (4) Date: Mar. 18, 2011

(87) PCT Pub. No.: WO2010/034293

PCT Pub. Date: Apr. 1, 2010

(65) Prior Publication Data

US 2011/0169282 A1 Jul. 14, 2011

(30) Foreign Application Priority Data

Sep. 24, 2008 (DE) ..... 20 2008 012 706 U

(51) Int. Cl.

| | |
|---|---|
| ***E05C 3/16*** | (2006.01) |
| ***E05B 85/26*** | (2014.01) |
| *E05C 3/02* | (2006.01) |
| *E05C 3/06* | (2006.01) |

(52) U.S. Cl.
CPC ..... *E05B 85/26* (2013.01)

(58) Field of Classification Search
USPC ..... 292/216, 219, 202, 203, 194, 195, 240, 292/121, 198, 220
See application file for complete search history.

(56) References Cited

U.S. PATENT DOCUMENTS

| | | | | |
|---|---|---|---|---|
| 5,046,769 | A * | 9/1991 | Rimbey et al. | 292/216 |
| 5,868,444 | A * | 2/1999 | Brackmann et al. | 292/201 |
| 6,428,058 | B1 * | 8/2002 | Graute | 292/216 |
| 6,540,271 | B1 * | 4/2003 | Kalsi | 292/216 |
| 6,695,360 | B1 | 2/2004 | Forsell et al. | |
| 6,866,311 | B2 * | 3/2005 | Spurr et al. | 292/216 |
| 8,827,329 | B2 * | 9/2014 | Scholz et al. | 292/216 |
| 2002/0163207 | A1 | 11/2002 | Rogers, Jr. et al. | |
| 2008/0224482 | A1 * | 9/2008 | Cumbo et al. | 292/216 |
| 2010/0052336 | A1 * | 3/2010 | Bendel et al. | 292/196 |
| 2011/0127780 | A1 * | 6/2011 | Barth et al. | 292/213 |
| 2011/0169280 | A1 * | 7/2011 | Scholz et al. | 292/200 |
| 2012/0068480 | A1 * | 3/2012 | Bendel et al. | 292/220 |

FOREIGN PATENT DOCUMENTS

| | | | |
|---|---|---|---|
| DE | 102007003948 | A1 * | 5/2008 |
| EP | 1 380 715 | A1 | 1/2004 |
| WO | 2008/061491 | A1 | 5/2008 |

* cited by examiner

*Primary Examiner* — Kristina Fulton
*Assistant Examiner* — Faria Ahmad
(74) *Attorney, Agent, or Firm* — Renner, Otto, Boisselle & Sklar, LLP

(57) ABSTRACT

The present invention relates to a lock unit (1) comprising at least one catch (2), wherein the catch (2) has a primary position (8) and a first position (9), a main pawl (3) having an axis of rotation (4), a blocking pawl (5), which blocks the main pawl (3) upon engagement with the catch (2), and a first pawl (6), which is rotatably disposed on the axis of rotation (4) of the main pawl and is engageable with the catch (2), wherein the lock unit (1) comprises at least one elastic element (7) that biases the blocking pawl (5) and the first pawl (6) against each other, at least part of the time, such that the tension between the blocking pawl (5) and the first pawl (6) is preferably the largest in the open position of the catch.

8 Claims, 2 Drawing Sheets

LOCK UNIT HAVING A MULTI-PART PAWL AND A SPRING-LOADED BLOCKING PAWL

CROSS-REFERENCE TO RELATED APPLICATIONS

This is a National Stage Application of International Patent Application No. PCT/DE2009/001318, with an international filing date of Sep. 18, 2009, which is based on German Patent Application No. 10 2008 012 706.8, filed Sep. 24, 2008.

BACKGROUND OF THE INVENTION

1. Field of the Invention

The present invention relates to a lock unit comprising at least one catch, wherein the catch has a primary position and a first position. An additional main pawl with an axis of rotation as well as a blocking pawl are provided, wherein the blocking pawl blocks the main pawl upon engagement with the catch. Further, the lock unit comprises a first pawl, which is rotatably disposed on the axis of rotation of the main pawl and is engageable with the catch.

Such lock units are mainly used for locking doors and/or hatches of motor vehicles.

2. Brief Description of the Related Art

Such a lock unit is described, for example, in WO 208/061491 A1. In the locking mechanism described therein comprising a catch, a release lever, a pawl, and a blocking lever, the primary position and the first position of the catch are disposed in two different planes and are actuated by two different levers, namely, the operating lever (for the first position) and the pawl (for the primary position). The locking mechanism has proven successful, but can be further improved.

Such lock units may be improved in this context, as an important example, by reducing the release forces and increasing the operational comfort. In addition, one must also consider that these components are mass-produced. The technical and cost factors must, therefore, also be taken into account. The integration of such lock units into motor vehicles must occur while taking into account the tight installation space available as well as the desirability of a long lifetime and a variety of operating activities. The noise of the lock unit or the locking mechanism plays an important role during its actuation.

BRIEF DESCRIPTION OF THE INVENTION

On this basis, it is the task of the present invention to solve the prior art problems, at least partially. In particular, a lock unit is taught, which features reliable operation and low noise. In addition, components of the locking mechanism are actuatable and movable toward one another by simple means.

These tasks are achieved with a lock unit having the features as in claim 1. Advantageous embodiments of the locking device are given in the dependent claims. It should be noted that in the claims, individually listed features can be combined in any technologically sensible way and to show further embodiments of the invention. The description, especially taken together with the figures, provides more details of the invention and the particularly preferred embodiments.

Accordingly, a lock unit is taught, which comprises at least one catch, wherein the catch comprises a primary position and a first position, a main pawl with an axis of rotation, a blocking pawl, which arrests the main pawl upon engagement with the catch, and a first pawl, which is rotationally disposed on the axis of rotation of the main pawl and is engageable with the catch. In addition, the lock unit comprises at least one elastic element that provides tension, at least part of the time, between the blocking pawl and the first pawl, wherein the tension is the largest in the open position of the catch.

Such a lock unit is normally arranged in a (at least partially) sealed lock housing, which is disposed on the vehicle body, especially on the door of the vehicle. Such a lock unit comprises a locking mechanism, of which the catch is a key component. The catch is used for fixing a catch bolt (also called a locking bolt or a latch pin). The catch, in its closed position, surrounds a part of the catch bolt. In this closed position, the main pawl sits closely against the primary position of the catch. The primary position is particularly a recess or a projection at the circumference or the side area of the catch. The main pawl is rotatably mounted on an axis of rotation, which is disposed away from the axis of rotation of the catch. The catch, in addition to its open position and its closed position, also has an intermediate position, the so-called first position. In this first position, the closing movements of the lock unit or the vehicle door are not completely finished. However, the catch is already blocked to prevent the catch bolt from being released. In this first position, the first pawl engages with the catch, namely, the first pawl contacts the first position of the catch. The first position may be formed as a protrusion or recess on the periphery or side surface of the catch. The main pawl and the first pawl are mounted on a common axis of rotation and can be pivoted relative to one another, especially because of their asynchronous engagement with the catch. The arrangement of the main pawl and the first pawl on a single axis leads to a particularly compact design of the locking mechanism. Moreover, it should be noted that the catch, the main pawl, the blocking pawl and/or the first pawl may be components made of metal fabricated by stamping.

Known are locking mechanisms, in which the main pawl alone holds the catch in the closed position. However, also known are locking mechanisms, in which the catch and the pawl form a "self-opening mechanism." In such a locking mechanism, the catch is spring-loaded, and a force acts on the catch in a closed position via the door seals and the catch bolt. Because of this force, the catch transfers a moment of rotation onto the main pawl when the catch and the pawl contact each other in the area of the primary position. This means that the main pawl must be secured or blocked so that it is not pushed away by the catch. For this purpose is provided a blocking pawl, which arrests the main pawl during its engagement with the catch. The blocking pawl, which blocks the self-opening mechanism, is positioned such that the blocking pawl rests against the main pawl on the side of the main pawl, which lies opposite the catch. In this way, the blocking pawl works against the moment of rotation formed by the catch with respect to the main pawl. This blocking pawl is preferably also pivotable.

Moreover, provided is also an elastic element, which acts between the blocking pawl and the first pawl such that these components are tensioned against each other, and the motion of one element is transferred onto the other via the elastic element. This interaction of the elastic element with the blocking pawl and the first pawl need not apply for all available positions of the lock unit, but such a design is preferred. The elastic element is particularly designed or arranged such that by moving the blocking pawl and/or the first pawl, a variable spring force is achieved between these components. It is particularly preferred that the largest spring force is provided when the lock unit is in the open position. However, in a preferred embodiment, a positive spring force is also deployed in the closed position. Thus, in the closed position, the blocking pawl acts on the main pawl such that the main pawl is positioned in front of the primary position of the catch, and, additionally, the first pawl is pre-tensioned toward the catch via the elastic element such that the elastic element is fixed in a predetermined position and is relatively quiet, even during operation of the vehicle and vibrations associated therewith. In principle, the elastic element can also be executed in several parts, although a one-piece design is preferred. In principle, a plurality of elastic elements may act between the blocking pawl and the first pawl, but to reduce the number of parts, it is preferred to provide a single elastic element. The elastic element is most preferably made of a metallic material.

It is preferred also that the at least one elastic element, at least during the closing operation of the lock unit, transfers a moment of rotation both onto the blocking pawl as well as onto the first pawl. Thus, the elastic element acts, in particular, as a return spring for these components such that the components are able to assume their preferred stop positions. Especially in this case, the restoring force, provided by means of the elastic element, should be the greatest in the arrangement in which the blocking pawl and the first pawl are in the open position of the catch up until the first position and, thereafter, the restoring force should be partially reduced, wherein the remaining restoring force should be at least sufficiently large so as to pivot the blocking pawl against the catch when the primary position is reached. To ensure reliable operation of the components, it is preferred that, in this phase, a spring force acts between the blocking pawl and the first pawl.

Such a configuration of the elastic element increases the safety during operation of the lock unit. In known locks, many individual reset springs are used, which allow for a closing movement, even when the single reset spring is broken. Thus, it is not evident to the user that a malfunction is present. In contrast, when the elastic element of the lock described here is faulty, the drive for the first pawl, which engages with the catch, fails to engage with the catch, and, at the same time, the spring force is secured against the catch such that the lock unit can no longer be closed. Thus, a sensor-based monitoring of the components can be easily implemented.

According to a further embodiment of the lock unit, the elastic element comprises a spring, and the spring is preferably mounted together with the blocking pawl. The elastic element can, in principle, also include other components, but an implementation with a single spring is preferred. The elastic element is most preferably made of a metallic material. For a space-saving arrangement, the spring is mounted on the rotational axis of the blocking pawl. It is possible that a part of the spring is positioned such that it is stationary, but it is also possible that the entire spring can rotate about a rotational axis of the blocking pawl, depending on the different positions of the blocking pawl and/or the first pawl. In any case, it should be ensured that the position of the spring between the two elements, the blocking pawl and the first pawl, is maintained safely. Principally, it is possible that the elastic element or spring cooperates with the outer contour of the blocking pawl and/or the first pawl, but is also possible that the elastic element, or, as the case may be, a spring, engages into a corresponding recess (for example, a side surface, which may be a hole) of the blocking pawl and/or the first pawl.

In addition, in a preferred embodiment of the lock unit, the blocking pawl and/or the first pawl are connected to an actuating element. The actuating element may be implemented, in particular, as a lever and is used for, example, to initiate an opening movement, wherein it is connected by a lever mechanism and/or Bowden cables with a door handle. The blocking pawl and the first pawl can move synchronously or asynchronously with the actuating element. Even a single actuation is possible.

Moreover, advantageously, the catch moves the main pawl alone out of the closed position when the blocking pawl sets free the main pawl. The preceding sentence relates in particular to the so-called "self-opening mechanism" described above.

In a further embodiment of the invention, the main pawl is engageable with the primary position and the first pawl is engageable with the first position, wherein the main pawl and the primary position are disposed in a first plane and the first pawl and the first position are disposed in a second plane. In other words, the blocking of the catch in this locking mechanism occurs in two different planes, perpendicular to the axis of rotation of the catch. The first position is implemented, e.g., as a projection on the side of the catch. It is particularly preferred that the blocking pawl is disposed in the first plane.

In this context, it is preferred that a first leg of the elastic element lies tightly against a first backdrop of the first pawl, at least part-time, and a second leg of the elastic element lies tightly against a second backdrop of the blocking pawl, at least part-time, wherein the first leg of the elastic element is disposed in the second plane and the second leg of the elastic element is disposed in the first plane.

The first leg and the second leg of the elastic element are preferably of an L-shaped design, whereas the portion of the elastic element that connects the legs is wire-like and is disposed like a spiral around the bearing of the blocking pawl. With their short bent end portion, the legs contact the first backdrop of the first pawl or the second backdrop of the blocking pawl at the circumference. It is preferred that, during the movement of the first pawl, the first leg is relatively free to move on the first backdrop of the first pawl, or, as the case may be, is led along the first backdrop of the first pawl. To this end, the first backdrop of the first pawl preferably has a guide section of several millimeters, for example, up to 5 mm or up to 10 mm. In addition, it is also preferred that such a fixation of the second leg at the blocking pawl is not implemented, but rather that a fixed position at the blocking pawl is realized. This is especially made possible because the contact point of the second leg at the blocking pawl turns with the entire surface structure such that the distance to the bearing does not change.

In a further embodiment of the lock unit, the first pawl comprises an arm for limiting the rotational angle, which rests part-time against a stop for limiting the rotational angle. The first pawl not only has an arm that is ultimately brought in contact with the first position of the catch, but, in addition, also has a smaller arm for limiting the rotational angle, which particularly projects laterally. In addition, in this lock unit, provided is a stop for limiting the rotational angle in a position between the first pawl and the blocking pawl. This stop for limiting the rotational angle may be implemented as a pin and, when appropriate, may be surrounded by cushioning material.

When the catch has reached a position between the first position and the primary position, the first pawl is actuated by means of the elastic element into a position such that the arm for limiting the rotational angle presses against the stop for limiting the rotational angle. In other positions of the catch up until the open position, the first pawl lies tightly against the catch and is fixed in a predetermined position by means of the elastic element and the catch.

The invention has particular application in a motor vehicle comprising at least one inventive lock unit described herein.

The invention and the technical background are explained in more detail hereinbelow with reference to the figures. The figures show particularly preferred embodiments of the invention, but the invention is not limited thereto.

DETAILED DESCRIPTION OF THE INVENTION

Figure 1:
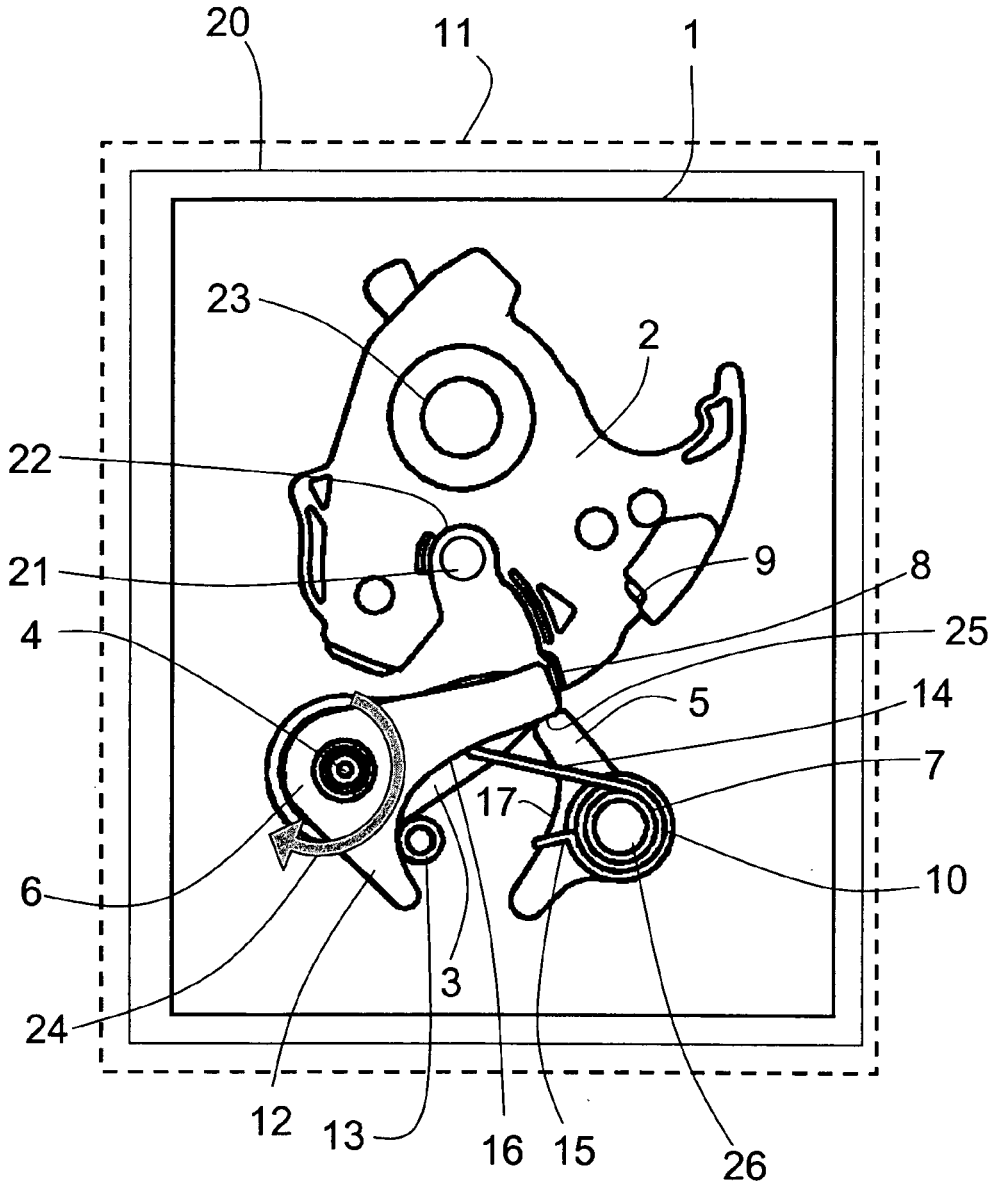
FIG. 1 shows an embodiment of the lock unit in a closed position.

First, it must be noted that identical components are labeled in the figures with identical reference characters.

FIG. 1 illustrates a lock unit 1 of a motor vehicle 11, shown here in a simplified fashion. The locking mechanism comprises a rotary latch 2, a main pawl 3, a blocking pawl 5 and a first pawl 6. The locking mechanism is arranged in a housing 20, which is positioned, e.g., on a vehicle door. The lock unit 1 has the task of fixing a catch bolt 21, which is, e.g., attached to a vehicle body, in the closed position.

The catch 2, which is usually mounted to rotate on a rotational axis 23, comprises a catch bolt recess 22, a primary position 8, and first position 9. In the closed state, shown in this figure, the catch bolt 21 is securely received and held in the catch bolt recess 22 of the catch 2. The rotation of the catch 2 (here clockwise), which is a result of the preloaded spring tension, is hampered because the main pawl 3 fits tightly against the primary position 8 of the catch 2. Within this contact area, a force is transmitted from the catch 2 onto the main pawl 3, which is not directed onto the axis of rotation 4 of the main pawl (self-opening mechanism). The force transmitted from the catch 2 onto the main pawl 3 results in a torque on the mail pawl 3 in the clockwise direction.

In order to prevent the rotation of the main pawl 3 as a result of the torque 24 and, in turn, to prevent the opening of the lock unit 1 by releasing the catch 2, the main pawl 3 is blocked from pivoting in the clockwise direction by the blocking pawl 5, which is pivotably disposed on the axis of rotation 26 of the blocking pawl. In other words, the blocking pawl 5 forms a stop 25 for the main pawl 3 in the closed position of the lock unit 1, wherein the applied force is transferred through the axis of rotation 26 of the blocking pawl. Thus, the main pawl 3 is securely fixed to the primary position 8 of the catch 2. Consequently, even during a further counter-clockwise rotation of the catch 2 (for example, when the door seal is compressed), a secure positioning of the main pawl 3 is guaranteed by the blocking pawl 5.

On the blocking pawl 5, rotatably arranged around the axis of rotation 26 of the blocking pawl 5 is an elastic element 7. This elastic element 7 is implemented as a (return) spring 10 and comprises a first leg 14 and a second leg 15. The first leg 14 is engaged with a first backdrop 16 of the first pawl 6, and the second leg 15 is engaged with a second backdrop 17 of the blocking pawl 5. The first backdrop 16 and the second backdrop 17 are implemented such that the end sections 28 of the first leg 14 and of the second leg 15 can slide on the respective surfaces (guide section 29).

Alternating torques are imparted onto the blocking pawl 5 and the first pawl 6 via the elastic element 7. It is preferable that the current spring force is changed or set only by the positions of both components, the blocking pawl 5 and the first pawl 6. In order to limit the resultant anti-clockwise rotation of the first pawl 6, the first pawl 6 comprises an arm 12 for limiting the angle of rotation, which strikes a hollow cylindrical stop limiter 13 in the closed position of the lock unit 1.

In the second plane 19 (see FIG. 2), which lies further up with respect to the observer plane, is located a first position 9 on the catch 2 which, in a particular orientation of the catch 2 (not shown here), contacts the first pawl 6.

Figure 2:
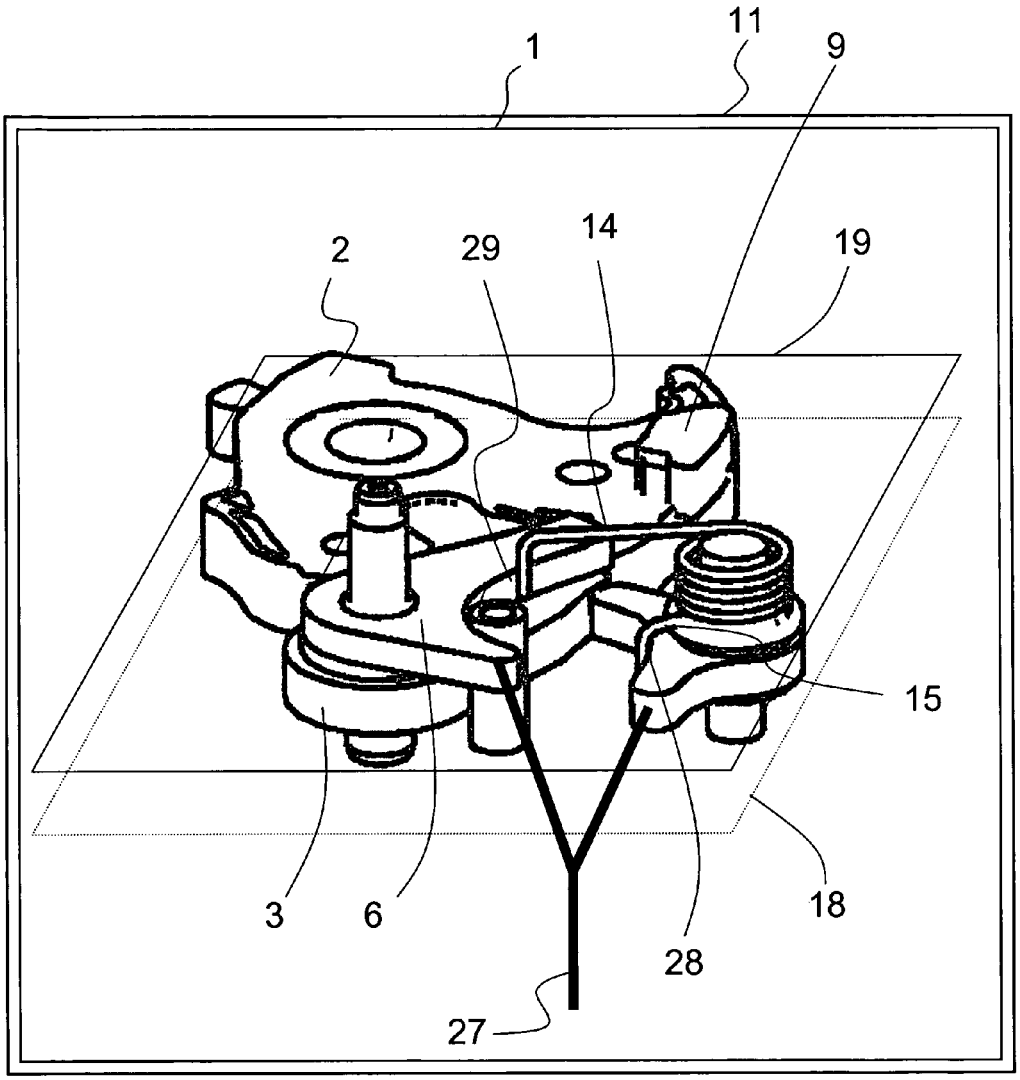
FIG. 2 shows a perspective view of the lock unit of FIG. 1.

FIG. 2 shows a perspective view of the above-described lock unit 1, which is installed in or on a motor vehicle 11. In this view, the spatial arrangement of individual elements of the lock unit 1 is particularly clear. Thus, FIG. 2 shows that the first position 9 of the catch 2, the first pawl 6 and the elastic element 7 are disposed, at least substantially, in the second plane 19, whereas the remaining elements of the lock unit 1 (the catch 2, the main pawl 3, and the blocking pawl 5) are disposed, at least substantially, in the first plane 18.

An actuating element 27 is provided for initiating the opening sequence. The actuating element 27 simultaneously actuates the blocking pawl 5 and the first pawl 6, wherein the actuating element 27 is implemented, e.g., as a pivotable lever plate.

The device illustrated in FIGS. 1 and 2 may be implemented in different ways with respect to the form and number of the particular components.

REFERENCE LIST

1. Lock unit
2. Catch
3. Main pawl
4. Axis of rotation of the main pawl
5. Blocking pawl
6. First pawl
7. Elastic element
8. Primary position
9. First position
10. Spring
11. Motor vehicle
12. Arm for limiting the rotational angle
13. Stop for limiting the rotational angle
14. First leg
15. Second leg
16. First backdrop
17. Second backdrop
18. First plane
19. Second plane
20. Housing
21. Catch bolt
22. Catch bolt recess
23. Pawl rotation axis
24. Torque
25. Stop
26. Axis of rotation of the pawl
27. Actuator,
28. End section,
29. Guide section

The invention claimed is:

1. A lock unit comprising at least one catch movable between an open position and a closed position, wherein said catch has a primary position and a first position, a main pawl having an axis of rotation, the main pawl movable between a locking position engaging the primary position of the catch for holding the catch in its closed position and a release position out of engagement with the primary position for allowing the catch to move toward its open position, a blocking pawl movable between a blocking position and an unblocking position, the blocking pawl in its blocking position being directly engaged with the main pawl and blocking said main pawl from movement out its locking position when the main pawl is engaged with the primary position of said catch, and the blocking pawl in its unblocking position allowing the main pawl to move out of its locking position, a first pawl, which is rotatably disposed on said axis of rotation of said main pawl and is engageable with the first position of said catch, and at least one elastic element that provides tension between said blocking pawl and said first pawl, at least during part of the time that the catch moves between its open and closed positions, wherein said main pawl is engageable with said primary position and said first pawl is engageable with said first position, wherein said main pawl and said primary position are disposed in a first plane and said first pawl and said first position are disposed in a second plane, and wherein a first leg of said elastic element contacts with a first backdrop of said first pawl, at least during part of the time the catch moves between its open and closed positions, and a second leg of said elastic element contacts with a second backdrop of said blocking pawl, at least during part of the time the catch moves between its open and closed positions, wherein said first leg of said elastic element is disposed in said second plane and said second leg of said elastic element is disposed in said first plane.

2. The lock unit of claim 1, wherein said at least one elastic element transfers a moment of rotation both onto said blocking pawl as well as onto said first pawl, at least during part of the time that the catch moves between its open and closed positions.

3. The lock unit of claim 1, wherein said elastic element comprises a spring, and wherein said spring is preferably mounted together with said blocking pawl.

4. The lock unit of claim 1, wherein said blocking pawl and/or said first pawl is connected to an actuating element.

5. The lock unit of claim 1, wherein the catch will cause the main pawl to move out of its locking position when the blocking pawl sets free the main pawl.

6. The lock unit of claim 1, wherein said first pawl comprises an arm for limiting the rotational angle, which contacts, at least part-time, a stop for limiting the rotational angle.

7. A motor vehicle, comprising at least one lock unit of claim 1.

8. The lock unit of claim 1, wherein the tension is the largest when the catch is in its open position.

* * * * *